United States Patent [19]

Murmann et al.

[11] Patent Number: 4,800,245

[45] Date of Patent: Jan. 24, 1989

[54] KEY MODULE FOR KEY-ACTUATED MEMBRANE SWITCH PANELS

[75] Inventors: Gunter Murmann, Pegnitz; Walter H. Mertel, Sulzbach-Rosenberg, both of Fed. Rep. of Germany

[73] Assignee: Cherry-Mikroschalter GmbH, Auerbach, Fed. Rep. of Germany

[21] Appl. No.: 23,119

[22] PCT Filed: Jul. 31, 1986

[86] PCT No.: PCT/EP86/00453

§ 371 Date: Mar. 9, 1987

§ 102(e) Date: Mar. 9, 1987

[87] PCT Pub. No.: WO87/01236

PCT Pub. Date: Feb. 26, 1987

[30] Foreign Application Priority Data

Aug. 22, 1985 [DE] Fed. Rep. of Germany ..... 3530050

[51] Int. Cl.[4] ..... H01H 13/70

[52] U.S. Cl. ..... 200/345; 200/517 B; 200/286

[58] Field of Search ..... 200/340, 286, 249, 259, 200/159 B

[56] References Cited

U.S. PATENT DOCUMENTS

| | | | |
|---|---|---|---|
| 3,069,516 | 12/1962 | Whiffen | 200/286 |
| 4,328,406 | 5/1982 | Evans et al. | 200/293 |
| 4,467,150 | 8/1984 | Leitermann et al. | 200/159 B |
| 4,536,736 | 8/1985 | Aschenbach | 200/153 V |
| 4,553,009 | 11/1985 | Van Zeeland et al. | 200/340 |

FOREIGN PATENT DOCUMENTS

| | | | |
|---|---|---|---|
| 0384056 | 1/1965 | Switzerland . | |
| 2141874 | 1/1985 | United Kingdom | 200/340 |

*Primary Examiner*—Renee S. Luebke

*Attorney, Agent, or Firm*—Sandler & Greenblum

[57] ABSTRACT

A key module for a membrane switch keyboard has a flat spring running diagonally to the key housing on the bottom side which, with the aid of a plunger, is bent for the operation of membrane contacts. The flat spring with one free end is inserted into a slot which is open toward the top and permits an adjustment of the flat spring by pressure loading on the free end or on the bottom side against the lower section of the flat spring, which is adjacent to the bent free end. The free end of the flat spring is rigidly retained in a slot at the key housing. For the adjustment of the operating force a compression spring is arranged inside the plunger and is supported against a cross-piece running over the flat spring.

27 Claims, 4 Drawing Sheets

KEY MODULE FOR KEY-ACTUATED MEMBRANE SWITCH PANELS

BACKGROUND OF THE INVENTION

1. Technical Field of the Invention

The present invention relates to a key module used with key-actuated membrane switch panels including a flat spring which is unilaterally stretched within the key housing, as well as to a method for adjusting switch-over time.

2. Discussion of Relevant Information

A key module for membrane switch panels is disclosed by British Patent GB-A No. 2,141,874, in which the key housing has a bottom side on which a flat spring, bent at a right angle, extends unilaterally. The bent end of the flat spring is inserted from the bottom of the housing into an opening in the key housing. A plunger is displaceable within the key housing, and the plunger acts on the free end of the flat spring to bend the flat spring downwardly, whereby an upper membrane of a membrane switch array is bent through a free area in a spacer against a lower membrane in order to place the contact point on the membrane into contact therewith. The plunger is guided within a tubular portion of the housing which, with respect to the central point of the mounting surface of the key module, is located oppositely from the slot, through which the stretched end of the flat spring can be taken out. A key cap can be attached to the top of the plunger. Insofar as the flat spring does not have adequate rigidity in order to achieve desired spring characteristics with a specified operating force, a compression spring is additionally provided and is arranged between the key cap and the key housing, the compression spring being positioned about the tubular portion which incorporates the plunger. This arrangement is disadvantageous insofar as the key module is capable of functioning only in a completely assembled condition, and, therefore, during production it is not possible to check the spring characteristics and the state of the switch-over time.

As discussed in European Application EP-A-187,396, a key module is provided which does not use such an additional compression spring; however, this key module requires a mounting space which extends over the modular area of the two key modules.

The key cap in British Pat. No. 2,141,874 is attached only to the plunger, and, further, the distance of the bottom side of the key cap from the key housing determines the span of the additional compression spring. As a result, it is difficult (in view of the unavoidable use of large mounting tolerances which are necessary to secure the plurality of key modules which must be accommodated within a single keyboard) to provide a constant initial operating force having very narrow tolerances. Therefore, it is desirable to provide a plunger stroke termination point with which the initial value of the operating force of the additional compression spring can be determined precisely during assembly of the key modules.

However, for a preferably designed keyboard, it is not only desirable that single key modules can be operated with precisely the same initial operating force, but also that switchover time, i.e., the time during which switching occurs, will be adjusted as precisely and as definitely as possible. During the process of inserting a flat spring into a key module in accordance with British Pat. No. 2,141,874, a large spread of different switch-over times is unavoidable, insofar as repositioning of the flat spring is very difficult to adjust. Further, not only the positioning of the flat spring but also, to a certain degree, the rigidity of the upper membrane, must be determined for a timely spreading of the switch-over time. It follows that it is desirable to be able to adjust the switch-over time not only during assembly of the key module, but also after assembly of the key module on a membrane switch panel, particularly for high priced keyboards, such as keyboards for word and data processing systems.

Therefore, the invention has an object the provision of a key module for a membrane switch keyboard, with the switch-over time being adjusted as precisely as possible, specifically with respect to the switch-over time as well as to the operating force required during the switch-over time.

The problem is solved by a key module formed in accordance with the claims and a method for adjusting switch-over time as defined by the claims.

Additional details of the invention are recited in the depending claims.

SUMMARY OF THE INVENTION

The objects of the invention are achieved in an advantageous matter by producing a key module, with which membrane switch keyboards can be manufactured, so as to satisfy the highest requirements with respect to an equal initial operating force of all installed key modules, and with respect to a precisely adjusted switch-over time, as well as with respect to providing a constant operating force during the switch-over time. By self-locking the stretched end of the flat spring, which projects upwardly from a slot top, and which has a section exposed as it passes through an opening in the membrane switch panel, which section borders along the stretched end of the spring, the flat spring can be precisely adjusted, as can the switch-over time, by very slight adjusting strokes made with a ramming tool. Insofar as the cross piece which supports the compression spring runs over the switch spring within the key housing, the operating force determining compression spring can be clamped precisely between the plunger and the key housing. Thus, a very high uniformity in adjustment of the operating force is possible, insofar as the compression springs can be mounted in a highly consistent fashion with respect to their spring constant. Further, insofar as the plunger is provided with flexible hooks which extends underneath locking shoulders on the key housing and which terminate the upstroke of the plunger, the initial operating force can be determined precisely because of the possibility that both the plunger and the key housing can be manufactured with the highest dimensional accuracy and the smallest tolerances. From this possibility for determining a very precise and constant initial operating force for each key module, a very constant operating force during switch-over time is guaranteed when the key modules are assembled into a keyboard. Because of the advantages which are achieved by this invention, it is possible with key modules formed in accordance herewith to produce membrane keyboards which are especially well adapted for high professional use, e.g., word processing systems which provide higher writing input with greater writing speed due to the most accurate adjustment of the switch-over time point and the constant operating force.

BRIEF DESCRIPTION OF THE DRAWINGS

The advantages and features of the present invention result from the following description of an embodiment of the invention which is illustrated in the drawings, which are described hereinafter as follows.

DETAILED DESCRIPTION OF THE DRAWINGS

Figure 1:
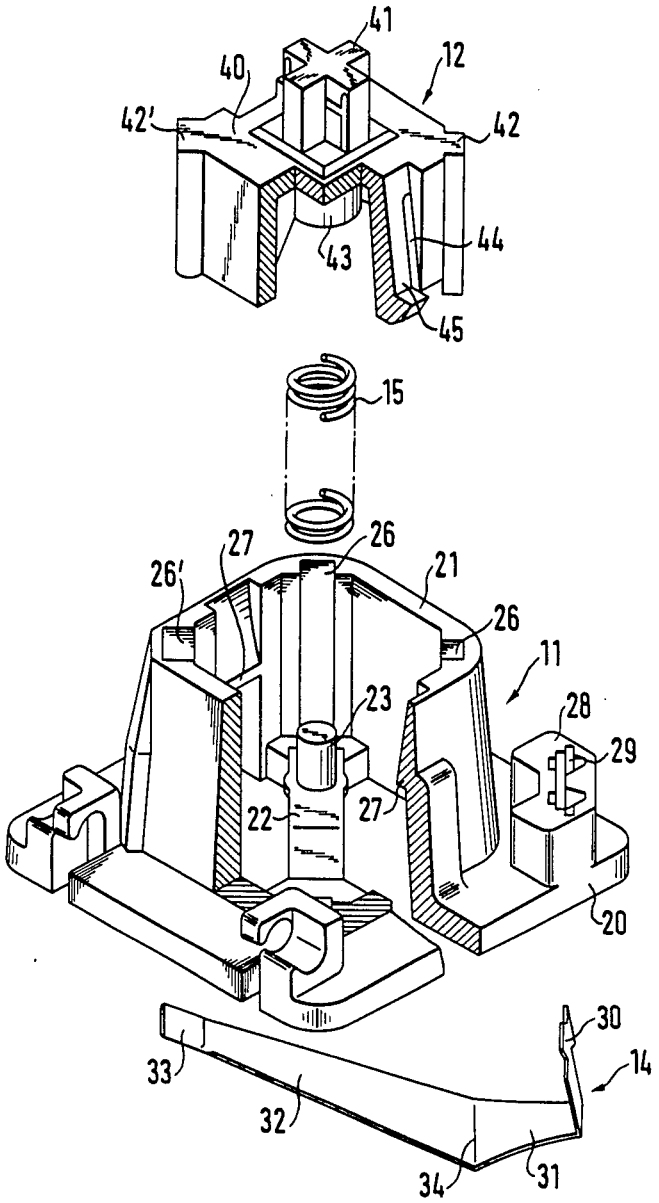
FIG. 1 is an exploded view of a key module formed in conformance with the present invention.
Figure 3:
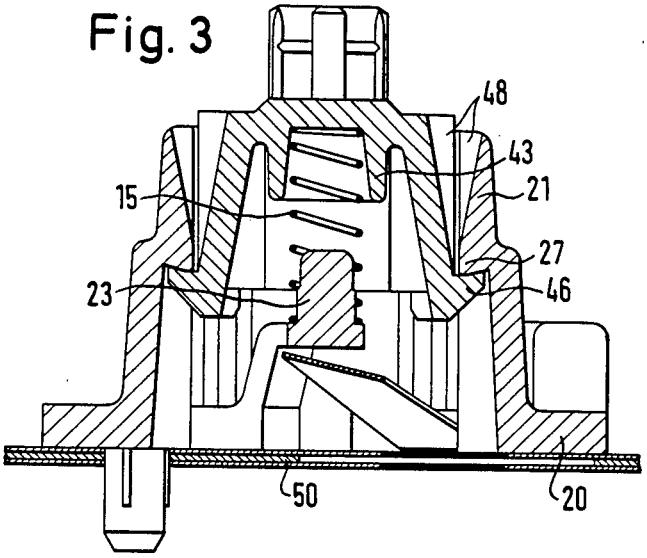
FIG. 3 is a cross-sectional view taken along line III—III of FIG. 2.

The key module which is illustrated in an exploded view in FIG. 1 comprises a key housing 11, a plunger 12, a flat spring 14, and a compression spring 15. Key housing 11 and plunger 12 are manufactured with high dimensional accuracy using a well known injection molding method. Key housing 11, along its bottom, comprises an essentially flat base plate 20 from which a hollow tubular shoulder 21 having a substantially square cross section extends upwardly. Along the inside of the hollow tubular shoulder 21, and extending from about the planar surface of base 20, a cross piece 22 is provided which extends along the direction of a diagonal of the base plate. As can be seen in FIG. 3, the central portion of this member is arched upwardly and includes a pin 23 for holding the compression spring 15. In the inner area of the four corners of the hollow tubular shoulder 21, guide grooves 26 for receiving plunger 12 are provided. Additional locking shoulders 27 are provided along two opposed inner walls, the function of which is explained hereinafter.

Figure 2:
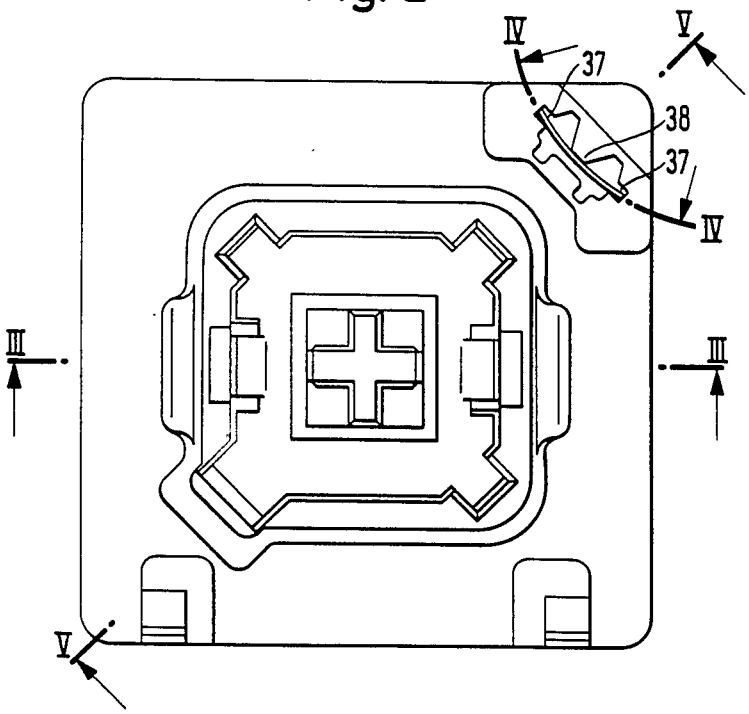
FIG. 2 is a top view of the key module of FIG. 1.

Flat spring 14 extends on the bottom side of the base plate along a diagonal which extends substantially perpendicular to cross piece 22 and along sectional line V—V in conformance with FIG. 2. A flat spring attachment 28 is provided on the base plate 20 in a corner area along which the section line runs; the attachment 28 is in the shape of a shoulder which extends upwardly and comprises a substantially vertical slot 29, into which, in accordance with FIGS. 4–7, an upwardly bent end 30 of flat spring 14 is insertable from the bottom of the slot. This slot is explained in greater detail hereinafter.

Flat spring 14 is formed in one piece and comprises a section 31, one side of which is connected to end 30, which extends perpendicularly upwardly from base plate 20. The other side of section 31 is connected to a spring arm 32, which, relative to the planar surface of section 31, extends upwardly at an acute angle. Spring arm 32 has a free end which comprises an impact surface 33.

Figure 5:
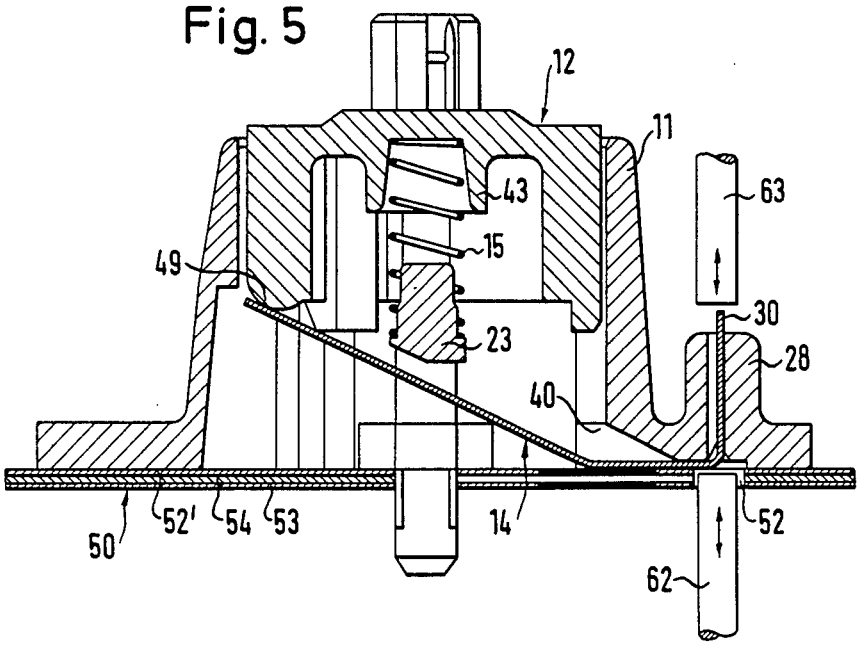
FIG. 5 is a cross-sectional view taken along line V—V of FIG. 2, with facilities for adjusting the flat spring in the key module with a ramming tool, with the plunger being located in a rest position.
Figure 6:
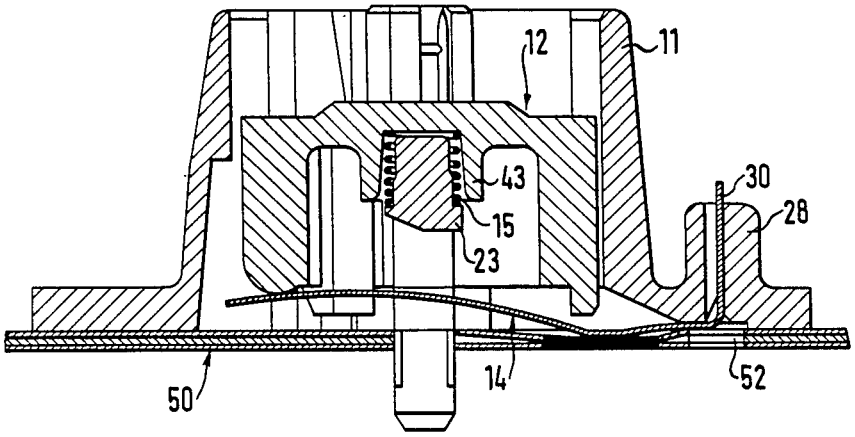
FIG. 6 is a cross-sectional view taken through the key module in an operative position of the module which corresponds to the sectional view of FIG. 5.

As can be clearly seen from FIGS. 3, 5 and 6, spring arm 32 extends under cross piece 22, with bending rim 34 resting above the contact area. Plunger 12, which is insertable from the top into hollow tubular shoulder 21, is open towards its bottom side and has essentially a box-type structure. The plunger has a top surface 40 with an extension 41 onto which a key cap is mounted in a conventional fashion. Along corner areas of the plunger, guide ribs 42 are provided which pass into guide grooves 26 and key housing 11. A shell shaped housing 43 is positioned under extension 41 and on the inside of plunger 12, and a compression spring 15 is insertable into the housing, as illustrated in FIG. 3. Guide rib 42', which comes to rest over the point of impact surface 33, and is guided into guide 26', has a spherically shaped bottom so that the operating force needed for bending flat spring 14 while sliding on impact surface 33 can be applied with as little friction as possible.

Slots 44 are provided inside the walls of plunger 12 in order to provide a spring-type tongues 45 having hooks 46 which interlock with oppositely positioned locking shoulders 27. When the plunger 12 is inserted, hooks 46 extend underneath locking shoulders 27 and terminate the upstroke of the plunger, so that, due to the narrow dimensional tolerance between pin 23 of cross piece 22 and the shell-shaped housing 43, respectively, a definite and limited movement distance results; the distance, together with the narrow tolerances of compression spring 15, provides a manner of precisely and exactly determining the initial operating force for the key module. Due to the corresponding clearances 48 over each flexible hook 46, not only within the key housing but also in the plunger, flexible hooks 46 can be compressed with a simple tool when the plunger should be removed from the key housing.

Contrary to the arrangement of a compression spring on the outside of tubular shoulder 21, in accordance with well known practices, compression spring 15 of the present invention, which is mounted within the key module, provides, after plunger 12 and flat spring 14 have been assembled, advantages in that the flat spring can be adjusted and the key modules can be preselected prior to mounting of the key cap, which as a rule is attached only at the end of the keyboard assembly.

Accordingly, when using key modules in accordnce with the prior art, the mounting of lower quality key modules within a keyboard cannot be prevented, and must be replaced, therefore causing a disproportionately high loss of time when high quality requirements must be satisfied.

Figure 4:
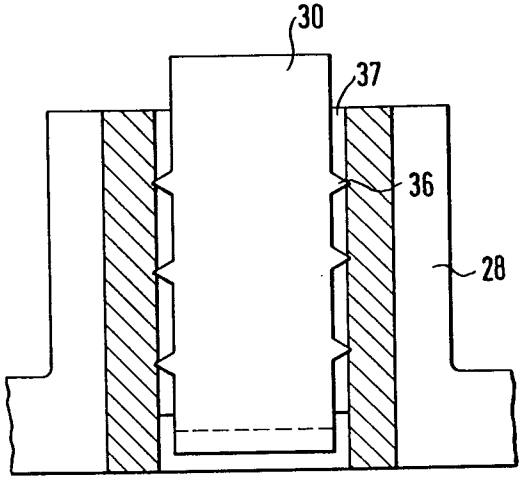
FIG. 4 is a cross-sectional view taken along line IV—IV of FIG. 2.

FIGS. 4-6 illustrate the assembly of a perpendicularly bent end 30 of flat spring 14 within flat spring attachment 28. As seen in FIG. 4, the side edges of free bent end 30 are provided with teeth 36, which, after the insertion of the free end into slot 29, clutch the sidewalls of the slot. The top view in conformance with FIG. 2 illustrates free end 30 within slot 29 as being inserted in a slightly curved fashion, while side grooves 37, which receive the side edges of free end 30, extend in a plane located beyond the front edge of rib 38 which extends essentially from top to bottom over the entire length of slot 29 along the plane of a diagonal of the key housing. Rib 38 does not touch the flat spring in the lower area where free end 30 merges into spring section 31.

The distance of rib 38 to the opposite wall of slot 29 is preferably larger than the thickness of the flat spring, so that, for insertion of a free end of the flat spring, the spring can be bent considerably with the aid of a tool, so that during insertion the side edges of teeth 36 can be moved along side grooves 37 without abutting the walls of the groove.

From FIGS. 5 and 6 it follows further that a clearance 40 is provided in the bottom surface of base plate 20, which clearance is deeper than the thickness of section 31 of flat spring 14. Due to the provision of clearance 40, an adequate free space is provided for adjustment of the flat spring.

Adjustment of the flat spring of a completely mounted key module is achieved either after assembly of the model on membrane switch panel 50, or after mounting the key module on a corresponding adjustment pattern, which, e.g., can be provided by an automatic assembly within an automatic assembly machine. Not only membrane switch panel 50, but also the adjustment pattern beneath free end 30 of flat spring 14, are provided with a through opening 52, through which a ramming tool 62 can be inserted. A corresponding ramming tool 63 is positioned over the free spring end 30 which projects from flat spring attachment 28. Both of the tools can pressure load the spring, either in a stroke type fashion or continuously, and can shift the free end of the spring within vertical slot 29 downwardly or upwardly to adjust the switch-over time. Such an adjustment can be achieved automatically with ramming tools 62 and 63 being pressure loaded through a control circuit, which, dependent upon the measured setting of the switch-over time during an adjustment operation, causes the application of a greater or lesser number of adjusting strokes from the top or bottom.

For controlling ramming tools, known central circuits can be used with which the setting of the switch-over time, and its deviation from a desired value, are determined, and with which the ramming tools are accordingly controlled. Adjustment of the flat spring can also be achieved with the aid of only the upper ramming tool 63. For that purpose, the free end of the flat spring is inserted into slot 29 to its highest possible position. With assistance of the ramming tool, the free end is then slowly displaced downwardly by several quantitatively regulated strokes into a position in which the desired value of the setting of switch-over time is achieved. In such a position the flat spring is securely held by teeth 36, insofar as the teeth clutch, under the initial stress exerted by the curved flat spring, into the sidewalls of groove 37.

FIGS. 5 and 6 illustrate a key module which is mounted on a membrane switch panel, with FIG. 5 showing the flat spring in its rest position and FIG. 6 showing the flat spring in its actuated or operative position. The membrane switch panel comprises an upper membrane 52', a lower membrane 53, and a spacer 54 arranged between the membranes. In the contact area, spacer 54 is provided with holes such that the upper membrane 52' can be deflected towards the bottom through the hole in spacer 54 until it contacts lower membrane 53. Bending of upper membrane 52 follows, under the influence of bending rim 34, as can be seen in FIG. 6. Initially, via the influence of this structure, the initial operating force will be started, in order to move plunger 12 downwardly against the force of compression spring 15 and flat spring 14. By mounting the flat spring along one diagonal of the key module, a relatively longer spring arm results, so that secure contact will be ensured with a relatively low operating force. Because of the proportionately longer spring arm, an even characteristic can be achieved for the operating force, which means that while actuating the switch, the time setting of the switch-over time will by represented by a flat curve. The operating forces, which are desirable for membrane keyboards at between about 50–60 grams, can be achieved with a key module in accordance with the present invention having a key stroke which is sufficiently large for safe typing. No difficulties result from following up the initial operating force with a light and step-free increase after contact is established, by a final adjustment of compression spring 15 and flat spring 14. Since during an operating cycle of contact making, the flexion of upper membrane 52 itself serves as an additional spring, the key operation functions as a series-connection of three springs which automatically leads to a larger spread with respect to switch-over time. Because of this, it is desirable to pre-adjust the key modules prior to mounting in the keyboard, and to finally adjust the different key modules after mounting in the keyboard, in order to eliminate the influence of the membrane of the spread, and to provide a switch-over time for all modules of the keyboard in an area of very narrow tolerances. For this purpose, the already noted opening 52 is provided in the membrane switch panel so that after assembly of the keyboard each single key module can be adjusted very accurately with ramming tool 62 or 63.

Figure 7:
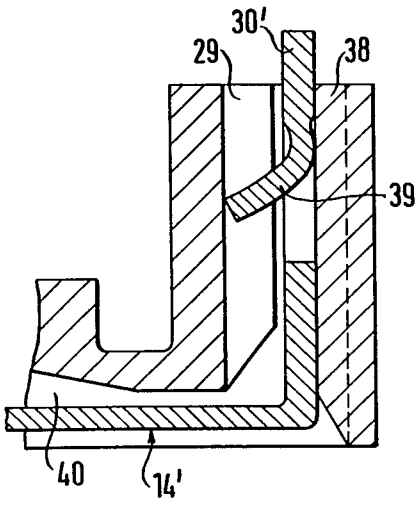
FIG. 7 is a partial cross-sectional view taken through another model of the self locking flat spring fastener used in the present invention.

FIG. 7 illustrates as additional model type of a self locking flat spring 14' which is illustrated as being positioned within a flat spring attachment 28. This attachment is built in the same manner as the previously described key module; however, the perpendicularly bent end 30' of the flat spring is provided with a punch out tongue 39, which in the plan surface of the housing diagonal is bent outwardly from end 30' of the flat spring, and rests with a sharp edge against the wall of opening 29 which is located oppositely from rib 38. Tongue 39 is clamped in the vertical slot, particularly under the action of ramming tool 63, as demonstrated in FIG. 5, as it is pressure loaded from the top. The bent out tongue 39 can be provided in slot 29 in addition to the lateral teeth 36, or also as the only way of self-locking clutching of the flat spring. Finally, although not illustrated in the drawings, two tongues can be used which are pressed outwardly from the free end of the spring, in opposite directions, and which are engaged or clutched within opposite walls of slot 29.

We claim:

1. A key module adapted for use with a key-actuated membrane switch panel, said module comprising:

(a) a key housing comprising a base portion and a body portion;

(b) a plunger slidably disposed within said key housing; and (c) spring means secured within said base portion of said key housing, said spring means comprising a substantially flat spring which includes an upwardly bent portion and a substantially flat portion;

wherein said base portion includes a vertical shoulder, said shoulder comprising a vertically extending slot for accommodating said upwardly bent portion of said spring therein, said slot having an open top end so as to comprise means for receiving a tool for adjusting said spring.

2. The key module of claim 1 wherein said plunger includes a top end and a bottom end, said bottom end being open and said top end comprising extension means for mounting a key thereon.

3. The key module of claim 2, wherein said plunger has an interior surface which includes a plurality of longitudinally extending guide ribs integrally formed at respective corners of said plunger interior surface.

4. The key module of claim 3, further comprising a plurality of longitudinally extending guide grooves disposed within said body portion of said key housing along corners of said key housing for accommodating respective guide ribs therein.

5. The key module of claim 3, wherein each of said guide ribs having a lower end, wherein the lower end of one of said guide ribs is substantially spherical and contacts a portion of said flat portion when said plunger means is actuated.

6. The key module of claim 5, wherein said flat portion of said flat spring extends away from said upwardly bent portion at an angle relative to said base portion such that when said plunger is actuated said flat portion is bent downwardly.

7. The key module of claim 2, further comprising a cross-piece disposed diagonally and above said flat spring in said base portion of said key housing, said cross-piece comprising a vertically extending pin, said pin comprising means for retaining one end of a compression spring on said cross-piece.

8. The key module of claim 7, wherein said flat spring extends diagonally and at a right angle to said cross-piece.

9. The key module of claim 7, wherein said bottom end of said plunger comprises means for holding a second end of said compression spring when said plunger is assembled with said key housing.

10. The key module of claim 9, wherein said plunger comprises means for locking said plunger within said key housing when said key module is assembled.

11. The key module of claim 10, wherein said locking means comprises a plurality of longitudinally extending tongue-shaped members, each of said tongue-shaped members comprising a hook at one end thereof.

12. The key module of claim 11, wherein said body portion of said key housing comprises a plurality of shoulders equal in number to said hooks for clasping corresponding hooks of said tongue-shaped members, thereby detachably securing said plunger means with said key housing, whereby when said key is actuated by applying pressure thereon, said plunger slides downwardly within said key housing and thereby comprises means for commpressing said compression spring, and when said pressure is released said plunger slides upwardly under the application of the biasing force of said compression spring, said hooks being positioned in abutment with said shoulders, thereby terminating said upward motion of said plunger when said pressure is released.

13. The key module of claim 1, wherein said upwardly bent portion of said flat spring comprises a plurality of teeth along opposite side edges thereof, said teeth being in abutting engagement with an interior surface of said vertical slot.

14. The key module of claim 1, wherein said upwardly bent portion of said spring comprises at least one tongue abutting against the interior surface of said vertical slot.

15. The key module of claim 1 wherein said base portion comprises a clearance space for receiving a portion of said flat spring, said flat spring having a thickness, and said spring having a depth greater than the thickness of said flat spring.

16. The key module of claim 1, in combination with a membrane switch panel fixedly secured to said base portion of said key housing, said membrane switch panel comprising an upper membrane, a lower membrane, and a spacing means disposed between said upper membrane and said lower membrane.

17. The key module of claim 16, said spacing means comprising a plurality of holes for deflecting a portion of said upper membrane downwardly through one of said holes so as to contact a corresponding portion of said lower membrane.

18. The key module of claim 16 wherein said membrane switch panel comprises a hole located substantially adjacent to and below said extending slot of said shoulder means for exposing a portion of said flat spring exteriorly of said module.

19. The key module of claim 1, wherein said upwardly bent portion of said flat spring comprises a punched-out tongue, said tongue being in abutting engagement with an interior surface of said vertically extending slot.

20. A key module adapted for use with a key-actuated membrane switch panel, said module comprising:

(a) a key housing comprising a base portion and a body portion;

(b) plunger means slidably disposed within said key housing; and (c) spring means secured within said base portion of said key housing, said spring means comprising a substantially flat spring which includes an upwardly bent portion and a substantially flat portion, wherein said base portion includes a vertical shoulder, said shoulder comprising a vertically extending slot for accommodating said upwardly bent portion of said spring therein, said vertical shoulder being positioned on a corner of said base portion which is adjacent to and spaced from said body portion.

21. A key module adapted for use with a key-actuated membrane switch panel, said module comprising:

(a) a key housing comprising a base portion and a body portion;

(b) plunger means slidably disposed within said key housing; and (c) spring means secured within said base portion of said key housing, said spring means comprising a substantially flat spring which includes an upwardly bent portion and a substantially flat portion, said upwardly bent portion comprising a punched out tongue, wherein said base portion includes a vertical shoulder, said shoulder comprising a vertically extending slot, said vertically extending slot having an open upper end for accommodating said upwardly bent portion of said spring therein, said upwardly bent portion of said flat spring extending through said slot and being adjustably positioned within said slot, wherein said punched-out tongue is adapted to be positioned in abutting engagement with the internal wall of said vertically extending slot.

22. A key module adapted for use with a key-actuated membrane switch panel, said module comprising:

(a) a key housing comprising a base portion and a body portion;

(b) plunger means slidably disposed within said key housing; and (c) spring means secured within said base portion of said key housing, said spring means comprising a substantially flat spring which includes an upwardly bent portion and a substantially flat portion, said upwardly bent portion comprising a punched-out tongue;

wherein said base portion includes a vertical shoulder, said shoulder commprising a vertically extending slot for accommodating said upwardly bent portion of said spring therein, said slot having an open top end so as to comprise means for receiving a tool for adjusting said spring, said punched-out tongue being in abutting engagement with the internal wall of said vertically extending slot.

23. A key module in combination with a key-actuated membrane switch panel, said combination comprising:

(a) a key housing comprising a base portion and a body portion;

(b) plunger means slidably disposed within said key housing: and (c) spring means secured within said base portion of said key housing, said spring means comprising a substantially flat spring which includes an upwardly bent portion and a substantially flat portion; and (d) a membrane switch panel fixedly secured to said base portion;

wherein said base portion includes a vertical shoulder, said shoulder comprising a vertically extending slot for accommodating said upwardly bent portion of said spring therein, said slot having an open top end so as to comprise means for receiving a tool for adjusting said spring.

24. The key module of claim 23, wherein said plunger means includes a downwardly extending, open interior surface which includes a plurality of longitudinally extending guide ribs integrally formed along corners of said interior surface.

25. The key module of claim 24, further comprising a plurality of longitudinally extending guide grooves disposed within said body portion of said key housing along corners of said key housing for accommodating respective guide ribs therein.

26. The key module of claim 23 further comprising a cross-piece disposed diagonally and above said flat spring in said base portion of said key housing, said cross-piece comprising a vertically extending pin, said pin comprising means for retaining one end of a compression spring on said cross-piece.

27. The key module of claim 26, further comprising means for holding a second end of said compression spring when said plunger is assembled with said key housing.

* * * * *